US007831053B2

(12) United States Patent
Petersen et al.

(10) Patent No.: US 7,831,053 B2
(45) Date of Patent: Nov. 9, 2010

(54) SYSTEM AND METHOD FOR MATCHING MICROPHONES

(75) Inventors: Kim Spetzler Petersen, Smørum (DK); Meng Gou, Smørum (DK)

(73) Assignee: Oticon A/S, Smorum (DK)

( * ) Notice: Subject to any disclaimer, the term of this patent is extended or adjusted under 35 U.S.C. 154(b) by 1070 days.

(21) Appl. No.: 11/543,132

(22) Filed: Oct. 5, 2006

(65) Prior Publication Data

US 2007/0086602 A1 Apr. 19, 2007

(30) Foreign Application Priority Data

Oct. 6, 2005 (EP) ..... 05109293

(51) Int. Cl.
*H04R 3/00* (2006.01)
*H04R 1/02* (2006.01)
*H04R 1/40* (2006.01)

(52) U.S. Cl. ..... 381/92; 381/91; 381/97

(58) Field of Classification Search ..... 381/91, 381/92, 97, 98, 26, 122, 312, 313; 367/119, 367/131, 121
See application file for complete search history.

(56) References Cited

U.S. PATENT DOCUMENTS 7,471,798 B2 * 12/2008 Warren ..... 381/92
7,587,058 B2 * 9/2009 Fischer et al. ..... 381/313
2003/0198356 A1 * 10/2003 Thompson ..... 381/92

FOREIGN PATENT DOCUMENTS

EP 1 191 817 A1 3/2002
EP 1 458 216 A2 9/2004

* cited by examiner

*Primary Examiner*—Vivian Chin
*Assistant Examiner*—Friedrich Fahnert
(74) *Attorney, Agent, or Firm*—Birch, Stewart, Kolasch & Birch, LLP

(57) ABSTRACT

This invention relates to a system (10) and method for matching one or more microphones. A first and second microphone (110, 210) communicates, respectively, a first and second microphone signal to an amplitude compensating means (16) adjusting amplitude of the first microphone signal in accordance with amplitude of the second microphone signal. The amplitude compensating means (16) communicates an adjusted first microphone signal (100) and the second microphone signal (200) to a phase matching means (18) comprising a correction filter means (113) receiving the adjusted first microphone signal (100). The correction filter means (113) comprises a low-pass filter means (111), which is controlled in accordance with a subtraction between the first microphone signal output (102) and the second microphone signal (200), and a high-pass filter means (112), which is controlled in accordance with a comparison between the first microphone signal output (102) and the second microphone signal (200).

12 Claims, 1 Drawing Sheet

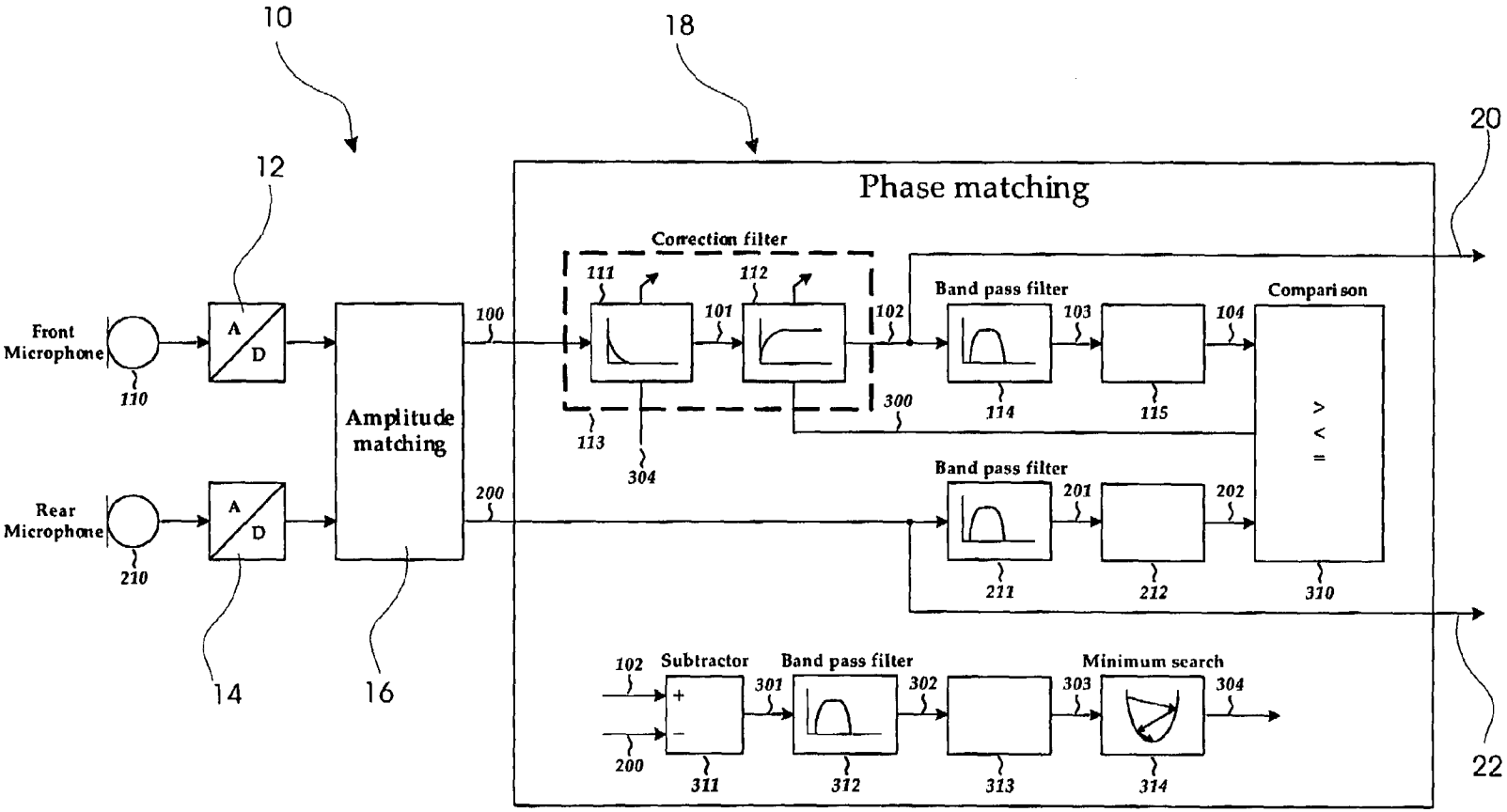
10
12
14
16
18
20
22
Front Microphone
Rear Microphone
110
210
A
D
Amplitude matching
100
200
Phase matching
Correction filter
111
112
113
101
102
300
304
Band pass filter
114
115
103
104
Band pass filter
211
212
201
202
Comparison
310
Subtractor
311
301
Band pass filter
312
302
313
303
Minimum search
314
304

SYSTEM AND METHOD FOR MATCHING MICROPHONES

FIELD OF INVENTION

This invention relates a system and method for matching microphones, in particular microphones of a hearing aid such as a behind-the-ear (BTE), in-the-ear (ITE) or a completely-in-canal (CIC) hearing aid.

BACKGROUND OF INVENTION

Hearing aids in general comprise one or more microphones for converting sound pressure to an electrical input signal. By placing two microphones spaced apart on each hearing aid the input signals from these two microphones may be used to perform a directionality focus of the hearing aid. Generating a directionality focus of a hearing aid improves the user's ability to hear sounds originating in front of the user, which is particularly advantageous in noisy surroundings.

European patent application EP 1 458 216, which hereby is incorporated in below specification by reference, discloses a system and method for matching hearing aid microphones. The system comprises a first microphone connecting to an infinite impulse response (IIR) filter controlled according to the following transfer function:

$$\frac{M_{in}}{M_{out}} = \frac{p_1(X_p)\cdot z + p_0(X_p)}{z + q_0(X_p)},$$

where $M_{in}$ is the microphone input, $M_{out}$ is the output of the IIR filter, z is the frequency variable, $p_1$, $p_0$ and $q_0$ are functions of controlling parameter $X_p$.

The functions $p_1$, $p_0$ and $q_0$ are described in European patent application EP 0 982 971 as abbreviations of a microphone model. The functions describe poles and zeros of the characteristics of a microphone response to frequency variances.

The controlling parameter $X_p$ ensures that the difference between acoustic response of the first microphone matches acoustic response of a second microphone. $X_p$ is calculated by comparing a band-pass filtered and amplitude compensated output of the IIR-filter with a band-pass filtered output of a reference microphone. The system utilises level measuring means for establishing a level of the first microphone's signal and a level of the reference microphone's signal. These levels are feed to a subtraction unit subtracting the levels. This result is forwarded to a threshold unit, which enables the generation of $X_p$ in an $X_p$-generator when the result is above a certain threshold.

The system only presents a single loop simultaneously adjusting polls and zeros, which causes the matching of the microphones to be inadequate. Hence there is still a need for further improvements in achieving matching of microphones in a hearing aid.

Further the amplitude compensation is executed independently on the output of the IIR-filter without direct reference to the reference microphone. Hence this microphone matching requires still further improvements.

SUMMARY OF THE INVENTION

An object of the present invention is to provide system solving the problems of the prior art shortcomings.

It is a further object of the present invention to provide hearing aid system providing amplitude as well as phase compensation relative to a plurality of microphones.

A particular advantage of the present invention is the utilisation of signal energy for determining filter adjustments thereby improving the reliability of the matching.

A particular feature of the present invention is the provision of double loop ensuring a unique and exact match of microphones.

The above objects, advantage and feature together with numerous other objects, advantages and features, which will become evident from below detailed description, are obtained according to a first aspect of the present invention by a system for matching one or more microphones and comprising a first and second microphone adapted to communicate, respectively, a first and second microphone signal to an amplitude compensating means adapted to adjust amplitude of said first microphone signal in accordance with amplitude of said second microphone signal and said amplitude compensating means adapted to communicated an adjusted first microphone signal and said second microphone signal to a phase matching means, wherein said phase matching means comprising a correction filter means adapted to receive said adjusted first microphone signal and having a controllable low-pass filter means and a controllable high-pass filter means and said correction filter means adapted to generate a first microphone signal output, wherein said phase matching means further comprising a comparator means adapted to compare said first microphone signal output with said second microphone signal and adapted to generate a first control signal to said high-pass filter means thereby controlling cut frequency of said high-pass filter means, and wherein said phase matching means further comprising a subtracting means adapted to subtract said second microphone signal from said first microphone signal output and adapted to generate a second control signal to said low-pass filter means thereby controlling cut frequency of said low-pass filter means.

The system according to the first aspect of the present invention provides significant advantages over prior art techniques since the system continuously monitors and compensates for both zero and pole variations inherent in the first and second microphones.

Further, the system according to the first aspect of the present invention reduces costs in particular in the production lines of hearing aids having one or more microphones since the microphones are easily matched so as to provide directional and/or omni-directional operations.

The low-pass filter means according to the first aspect of the present invention may comprise an $n^{th}$ order infinite impulse response (IIR) filter or finite impulse response (FIR), such as a $2^{nd}$, $3^{rd}$, or $4^{th}$ order Chebychev or Butterworth, a wave-digital filter, or any combinations thereof. Similarly, the high-pass means according to the first aspect of the present invention may comprise an $n^{th}$ order infinite impulse response (IIR) filter or finite impulse response (FIR), such as a $2^{nd}$, $3^{rd}$, or $4^{th}$ order Chebychev or Butterworth, a wave-digital filter, or any combinations thereof.

The comparator means according to the first aspect of the present invention may comprise a first and second band-pass filter means, respectively, adapted to generate a first and second frequency band signal. The comparator means may further comprise a first signal calculating means adapted to generate a first and second energy, power or mean signal from said first and second frequency band signal, respectively. The first signal calculating means may further be adapted to compare the first and second energy, power or mean signal and to generate said first control signal shifting cut frequency of said high-pass filter means when said first energy, power or mean signal is lower or greater than said second energy, power or mean signal. Thereby the first microphone signal is compensated for a variation between the inherent zeroes of the first and second microphones.

The subtracting means according to the first aspect of the present invention may further comprise a subtractor adapted to subtract the second microphone signal from the first microphone signal output and to generate a difference signal based thereon. The subtracting means may further comprise a third band-pass filter means adapted to generate a third frequency band signal. In addition, the subtracting means may comprise a second calculating means adapted to receive said third frequency band signal and to generate a third energy, power or mean signal from said third frequency band signal. The second calculating means may comprise a minimum searching means adapted to receive said third energy, power or mean signal and determine minimum thereof. The second signal calculating means may further be adapted to generate said second control signal in accordance with said minimum and shifting cut frequency of said low-pass filter means. Thereby the first microphone signal is further compensated for a variation between the inherent poles of the first and second microphones.

The above objects, advantages and features together with numerous other objects, advantages and features, which will become evident from below detailed description, are obtained according to a second aspect of the present invention by a method for matching one or more microphones and comprising: generating a first and second microphone signal by means of said one or more microphones, communicating said first and second microphone signal to an amplitude compensator, adjusting amplitude of said first microphone signal in accordance with amplitude of said second microphone signal and generating an adjusted first microphone signal by means of said amplitude compensator, communicating said adjusted first microphone signal to a correction filter having a controllable low-pass filter and a controllable high-pass filter, generating a first microphone signal output by means of said correction filter, comparing said first microphone signal output with said second microphone signal by means of a comparator, communicating a first control signal to said high-pass filter thereby controlling cut frequency of said high-pass filter by means of said comparator, and subtracting said second microphone signal from said first microphone signal output by means of a subtractor, communicating a second control signal to said low-pass filter thereby controlling cut frequency of said low-pass filter by means of said subtractor.

The method according to the second aspect of the present invention may comprise any features described with reference to the system according to the first aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein:

FIG. 1, shows a block diagram of a system for matching microphones according to a first embodiment of the present invention.

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilized and structural and functional modifications may be made without departing from the scope of the present invention.

FIG. 1 shows a system 10 for matching a front microphone 110 and a rear microphone 210 on a hearing aid. The front 110 and rear microphones 210 convert sound pressure to analogue electric signals, which are forwarded to analogue to digital converters 12 and 14 respectively converting the electric signals from the front 110 and rear 210 microphones to a front and a rear digital microphone signal.

The system further comprises an amplitude matching unit 16 receiving the front and rear digital microphone signals and performing an amplitude compensation. The amplitude matching unit 16 outputs a front microphone signal 100, which is amplitude compensated relative to the rear digital microphone signal, and outputs a rear microphone signal 200 corresponding to the rear digital microphone signal. In an alternative embodiment of the present invention the rear microphone signal 200 is amplitude compensated relative to the front digital microphone signal.

The front 100 and rear 200 microphone signals are input to a phase matching unit 18 compensating for variations in phase between the front 100 and rear 200 microphone signals. The phase matching unit 18 comprises a correction filter 113 having a controllable estimated first order infinite impulse response (IIR) low-pass filter 111 removing the high-pass effects inherent to the front microphone 110, thus introducing a pole in the signal path of the front microphone signal. The correction filter 113 further comprises a controllable estimated first order IIR high-pass filter 112 simulating the high-pass effects inherent to the rear microphone 210, thus introducing a zero in the signal path of the front microphone signal. Hence the front microphone signal 100 is forwarded from the amplitude matching unit 16 to the low-pass IIR filter 111 of the correction filter 113, which low-pass IIR filter 111 forwards output 101 to the high-pass IIR filter 112.

The corrected output 102 is forwarded to further processing in the hearing aid, which forwarding is indicated by arrow 20. In addition, the corrected output 102 is input to a first band-pass filter 114 passing a first frequency band signal 103 of the corrected output 102. The first frequency band signal 103 is defined between 20 and 150, 40 and 120, 50 and 100 Hz, or any combinations thereof.

The first frequency band signal 103 is forwarded to a first signal calculating means 115, which converts the first frequency band signal 103 to a first energy signal 104 by squaring and integrating this result over time and finally buffering the first energy signal 104. Alternatively, the first signal calculating means 115 converts the first frequency band signal 103 to a first power signal 104 by squaring, performing a weighted average calculation, and buffering the first power signal 104. Further alternatively, the first signal calculating means 115 means absolute value of the first frequency band signal 103 over a period of time and buffers a first mean signal 104.

The rear microphone signal 200 is input to the phase matching unit 18, where the rear microphone signal 200 is forwarded to further processing in the hearing aid indicated by arrow 22. In addition, the rear microphone signal 200 is input to a second band-pass filter 211 passing a second frequency band signal 201 of the rear microphone signal 200. The second frequency band signal 201 is similarly to the first frequency band signal 103 defined between 20 and 150, 40 and 120, 50 and 100 Hz, or any combinations thereof.

As described in relation to the first frequency band signal 103 the second frequency band signal 201 is forwarded to a second signal calculating means 212, which converts the second frequency band signal 201 to a second energy signal 201 by squaring and integrating this result over time and finally buffering the second energy signal 202. Alternatively, the second signal calculating means 212 converts the second frequency band signal 201 to a second power signal 202 by squaring, performing a weighted average calculation, and buffering the second power signal 202. Further alternatively, the second signal calculating means 115 means absolute value of the second frequency band signal 201 and buffers a second mean signal 202.

The phase matching unit 18 further comprises a comparator 310 for comparing the first and second energy, power or mean signals 104, 202. Obviously, the comparator 310 requires that the signals buffered in the first and second conversion means 115, 212 are of similar types.

When the first energy, power or mean signal 104 is greater than the second energy, power or mean signal 202 the comparator 310 generates a control signal to the controllable IIR high-pass filter 112 to shift the zero to a greater frequency. When on the other hand the first energy, power or mean signal 104 is smaller than the second energy, power or mean signal 202 the comparator 310 generates a control signal to the controllable IIR high-pass filter 112 to shift the zero to a lower frequency. In this way the phase matching unit 18 compensates firstly the variance between the front and rear microphone signals 100, 200 by shifting the zero of the IIR high-pass filter 112.

The phase matching unit 18 further comprises a subtraction unit 311 receiving the corrected output 102 and the rear microphone signal 200. The subtraction unit 311 subtracts the rear microphone signal 200 from the corrected output 102 and outputs a subtraction signal 301. This subtraction signal 301 is forwarded to a third band-pass filter 312 passing a third frequency band signal 302, defined by the frequency limits as described above, to a third signal conversion means 313. The third signal conversion means 313 may, as described above with reference to the first and second conversion means 115, 212, convert the third frequency band signal to a third energy signal 303, a third power signal 303, or a third mean signal 303.

The third energy, power or mean signal 303 is forwarded to a minimum search unit 314 determining the frequency at which the third energy, power or mean signal 303 has a minimum. This frequency forms the basis of a control signal 304 to the IIR low-pass filter 111, which control signal 304 shifts the pole of the IIR low-pass filter 111 so as to reduce the phase variance between the rear microphone signal 200 and the corrected output 102.

The first, second and third band-pass filters 114, 211 and 312 may be implemented as an $n^{th}$ order filter such as FIR or IIR filters, wave-digital filters, or any combination thereof.

This closed loop system continuously ensures that the difference between the microphone-signals is kept low so as to match the microphones.

This system is particularly advantageous since manual and time consuming matching operations may be avoided thus severely reducing costs of for example production of hearing aids with one or more microphones.

The invention claimed is:

1. A system for matching one or more microphones and comprising a first and second microphone adapted to communicate, respectively, a first and second microphone signal to an amplitude compensating means adapted to adjust amplitude of said first microphone signal in accordance with amplitude of said second microphone signal and said amplitude compensating means adapted to communicated an adjusted first microphone signal and said second microphone signal to a phase matching means, wherein said phase matching means comprising a correction filter means adapted to receive said adjusted first microphone signal and having a controllable low-pass filter means and a controllable high-pass filter means and said correction filter means adapted to generate a first microphone signal output, wherein said phase matching means further comprising a comparator means adapted to compare said first microphone signal output with said second microphone signal and adapted to generate a first control signal to said high-pass filter means thereby controlling cut frequency of said high-pass filter means, and wherein said phase matching means further comprising a subtracting means adapted to subtract said second microphone signal from said first microphone signal output and adapted to generate a second control signal to said low-pass filter means thereby controlling cut frequency of said low-pass filter means.

2. A system according to claim 1, wherein said low-pass filter means comprises an $n^{th}$ order infinite impulse response (IIR) filter or finite impulse response (FIR), such as a $2^{nd}$, $3^{rd}$, or $4^{th}$ order Chebychev or Butterworth, a wave-digital filter, or any combinations thereof.

3. A system according to claim 1, wherein said high-pass means comprises an $n^{th}$ order infinite impulse response (IIR) filter or finite impulse response (FIR), such as a $2^{nd}$, $3^{rd}$, or $4^{th}$ order Chebychev or Butterworth, a wave-digital filter, or any combinations thereof.

4. A system according to claim 1, wherein said comparator means comprises a first and second band-pass filter means, respectively, adapted to generate a first and second frequency band signal.

5. A system according to claim 4, wherein said comparator means further comprises a first signal calculating means adapted to generate a first and second energy, power or mean signal from said first and second frequency band signal, respectively.

6. A system according to claim 5 wherein said first signal calculating means is further adapted to compare the first and second energy, power or mean signal and to generate said first control signal shifting cut frequency of said high-pass filter means when said first energy, power or mean signal is lower or greater than said second energy, power or mean signal.

7. A system according to claim 1, wherein said subtracting means further comprises a subtractor adapted to subtract the second microphone signal from the first microphone signal output and to generate a difference signal based thereon.

8. A system according to claim 1, wherein said subtracting means further comprises a third band-pass filter means adapted to generate a third frequency band signal.

9. A system according to claim 8, wherein said subtracting means comprises a second calculating means adapted to receive said third frequency band signal and to generate a third energy, power or mean signal from said third frequency band signal.

10. A system according to claim 9, wherein said second calculating means may comprise a minimum searching means adapted to receive said third energy, power or mean signal and determine minimum thereof.

11. A system according to claim 10, wherein said second signal calculating means further is adapted to generate said second control signal in accordance with said minimum and shifting cut frequency of said low-pass filter means.

12. A method for matching one or more microphones and comprising: generating a first and second microphone signal by means of said one or more microphones, communicating said first and second microphone signal to an amplitude compensator, adjusting amplitude of said first microphone signal in accordance with amplitude of said second microphone signal and generating an adjusted first microphone signal by means of said amplitude compensator, communicating said adjusted first microphone signal to a correction filter having a controllable low-pass filter and a controllable high-pass filter, generating a first microphone signal output by means of said correction filter, comparing said first microphone signal output with said second microphone signal by means of a comparator, communicating a first control signal to said high-pass filter thereby controlling cut frequency of said high-pass filter by means of said comparator, and subtracting said second microphone signal from said first microphone signal output by means of a subtractor, communicating a second control signal to said low-pass filter thereby controlling cut frequency of said low-pass filter by means of said subtractor.

* * * * *